United States Patent [19]

Paulsen

[11] Patent Number: 4,978,322

[45] Date of Patent: Dec. 18, 1990

[54] COIN WIPER FOR ESCALATOR HOPPER

[75] Inventor: Craig Paulsen, Reno, Nev.

[73] Assignee: International Game Technology, Reno, Nev.

[21] Appl. No.: 310,562

[22] Filed: Feb. 13, 1989

[51] Int. Cl.[5] ..... G07D 9/06

[52] U.S. Cl. ..... 453/57; 222/349

[58] Field of Search ..... 209/660, 661, 650; 222/345, 349, 346; 221/243; 453/18, 29, 30, 32, 35, 37, 57

[56] References Cited

U.S. PATENT DOCUMENTS

| | | | |
|---|---|---|---|
| 2,990,975 | 7/1961 | Sereno | 222/349 |
| 3,933,162 | 1/1976 | Smith | 453/57 |
| 3,942,544 | 3/1976 | Breitenstein et al. | 133/4 R |
| 4,574,824 | 3/1986 | Paulsen et al. | 133/4 R |
| 4,592,377 | 6/1986 | Paulsen et al. | 133/5 R |
| 4,615,350 | 10/1986 | Boudville | 453/57 |
| 4,650,090 | 3/1987 | Orthey | 222/349 |

FOREIGN PATENT DOCUMENTS

| | | | |
|---|---|---|---|
| 3021327 | 12/1981 | Fed. Rep. of Germany | 453/57 |

*Primary Examiner*—Andres Kashnikow
*Assistant Examiner*—W. Todd Waffner
*Attorney, Agent, or Firm*—Townsend and Townsend

[57] ABSTRACT

A coin dispensing machine (10) of the type having a rotating pinwheel (22) is provided with a coin wiper (30) to substantially prevent coil jams. The wiper includes a resilient member (35) affixed to a stiffening member (40). The wiper is attached to the housing of the coil dispensing machine parallel to the surface of the pinwheel at a distance above the pinwheel surface about equal to a coin thickness, and along a chord of the pinwheel. As the pinwheel rotates, coins on the pinwheel surface are forced by the resilient member to lie flatly against the pinwheel surface or be rejected, thus minimizing jamming.

5 Claims, 5 Drawing Sheets

COIN WIPER FOR ESCALATOR HOPPER

BACKGROUND OF THE INVENTION

This invention relates generally to coin counting and dispensing mechanisms, and specifically to a coin wiper for minimizing jamming of such mechanisms.

Coin counting and dispensing machines are well-known in the art. For instance, Breitenstein et al. U.S. Pat. No. 3,942,544, discloses a hopper payout device that can be used for various coin denominations. Paulsen et al. U.S. Pat. No. 4,574,824, discloses an agitator for a coin hopper for improving payout efficiency. Paulsen et al. U.S. Pat. No. 4,592,377, describes a coin escalator for conveying coins discharged by a coin hopper to a higher elevation for discharge in a coin dispensing machine. Applicant incorporates by reference herein each said reference.

Coin dispensing mechanisms typically include an inclined hopper that holds coins in a hopper bowl and discharge a proper number of coins into a coin escalator. A pinwheel, whose periphery is sectioned with pins for isolating individual coins, rotates through the bowl. Coins from the hopper are picked up and carried on the surface of the pinwheel between adjacent pins. At payout, coins are carried by the rotating pinwheel to a coin counter mechanism and discharge chute and then to a coin elevator. When the counter mechanism determines that the proper number of coins has been paid-out through the discharge chute, the pinwheel stops rotating.

Coins are subject to jams for a number of reasons as they exit the coin hopper and enter the escalator. The coins may not be seated flatly against the surface of the pinwheel, and can jam as they exit the hopper. Even if a coin was seated flatly, when the pinwheel stops rotating, momentum can move the coin away from the pin on the pinwheel. When the pinwheel restarts, the pin will strike the coin, imparting momentum to the coin and causing the coin to be unstable as it exists the hopper, increasing the likelihood of a jam. Finally, excess coins can reach the escalator area simultaneously, causing a jam.

Jamming of the coin hopper is undesirable. Coin counting and dispensing mechanisms are profitable only when they are in active operation and receiving coins. For this reason, payout should be accomplished in as short a time as possible to maximize efficiency. A coin jam requires that the entire mechanism be shut down to permit a technician to gain access to the coin hopper and elevator mechanism to remove the source of the jam. While the source of the jam is being removed, the mechanism is inoperative. Further, following removal of the jam, there is no guarantee that jams will not re-occur.

SUMMARY OF THE INVENTION

The present invention is a coin wiper for reducing entry jams in a coin hopper and escalator. The coin wiper holds coins flatly against the pinwheel surface, absorbs coin momentum and prevents the coins from rolling forward when the pinwheel stops rotating. In addition, the coin wiper acts to deflect excess coins back into the hopper. In performing these functions, a coin wiper according to the present invention substantially eliminates coin jams.

The coin wiper includes a resilient member, a stiffening member and means for mounting the coin wiper across a chord of the pinwheel in a coin hopper such that the wiper contacts a diameter of each coin as the coin approaches the exit chute and coin elevator. The resilient member is positioned to hold coins flatly against the pinwheel surface, preventing coins from rolling forward when the pinwheel stops. The resilient member is sufficiently rigid, however, to deflect excess coins back into the bowl of the coin hopper as the pinwheel continues to rotate. In one embodiment, the coin wiper is pivotally attached to the coin hopper to facilitate rapid unjamming of the mechanism, should a jam occur.

A coin wiper according to the present invention advantageously minimizes coin jams in a coin hopper, while permitting rapid unjamming in the event of a jam.

Other aspects, features and advantages of the invention will appear from the following description wherein the preferred embodiments have been set forth in detail in conjunction with accompanying drawings.

DETAILED DESCRIPTION OF THE PREFERRED EMBODIMENTS

Figure 1:
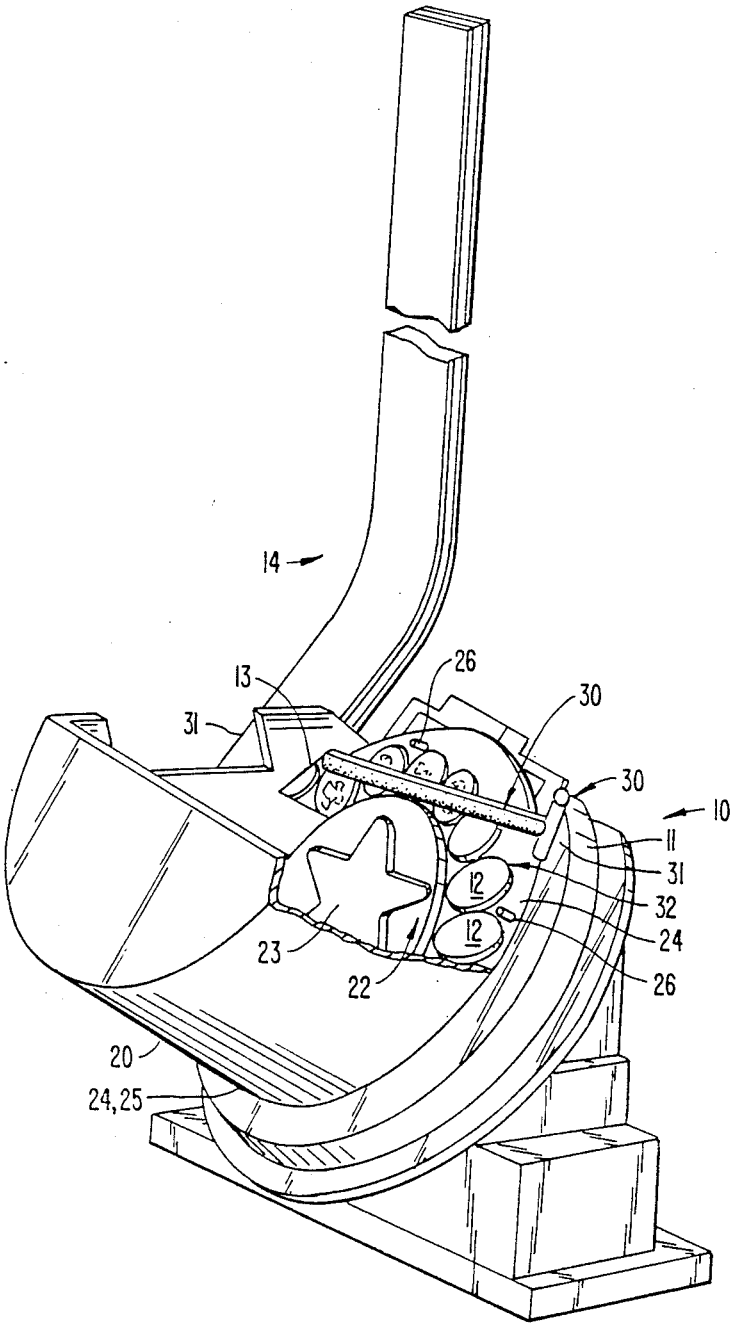
FIG. 1 is a perspective cut-away view of a coin hopper mechanism and coin escalator, with a coin wiper according to the present invention.

FIG. 1 shows a coin hopper 10 for dispensing coins 12 through an exit opening 13 into a coin elevator 14. Coin hopper 10 includes a frame 11, a scoop-shaped hopper bowl 20, a rotating pinwheel 22 with an agitator 23 in the center and a coin receiving section 24 on the periphery of the pinwheel. The periphery of the pinwheel 22 includes a number of pins 26 which define coin receiving sections between adjacent pins 26. Coin hopper 10 and elevator 14 are generally conventional in construction and will not be described in detail.

Normally a quantity of coins 12 lie in a heap (not shown) in the bottom-most portion 25 of bowl 20. In response to a payout command, pinwheel 22 is caused by a motor (not shown) to rotate in a counterclockwise direction. This rotation causes the coins 12 heaped together at the bottom-most portion 25 of bowl 20 to be agitated by agitator 23 and be contacted and picked up by pins 26 on coin receiving section 24 and carried onto the coin receiving section 24, one coin 12 lying between adjacent pins 26.

As pinwheel 22 rotates, the coins 12 lying between pins 26 are carried toward exit chute 13 and enter the elevator 14. As coins 12 exit the top of elevator 14, they are counted by an optical mechanism, not shown. When the proper number of coins 12 is dispensed into elevator 14, the motor (not shown) halts rotation of pinwheel 22. If coin wiper 30 were not present, coins 12 passing through exit opening 13 and entering elevator 14 could jam for the reasons described earlier.

A coin wiper 30 according to the present invention is mounted across a chord 31 of the pinwheel 22 so as to control area 32 of pinwheel 22 approaching the exit opening 13. More specifically, chord 31 is mounted so as to define a diameter 33 of each coin 12 approaching the exit opening 13 and coin elevator 14.

Figure 2A:
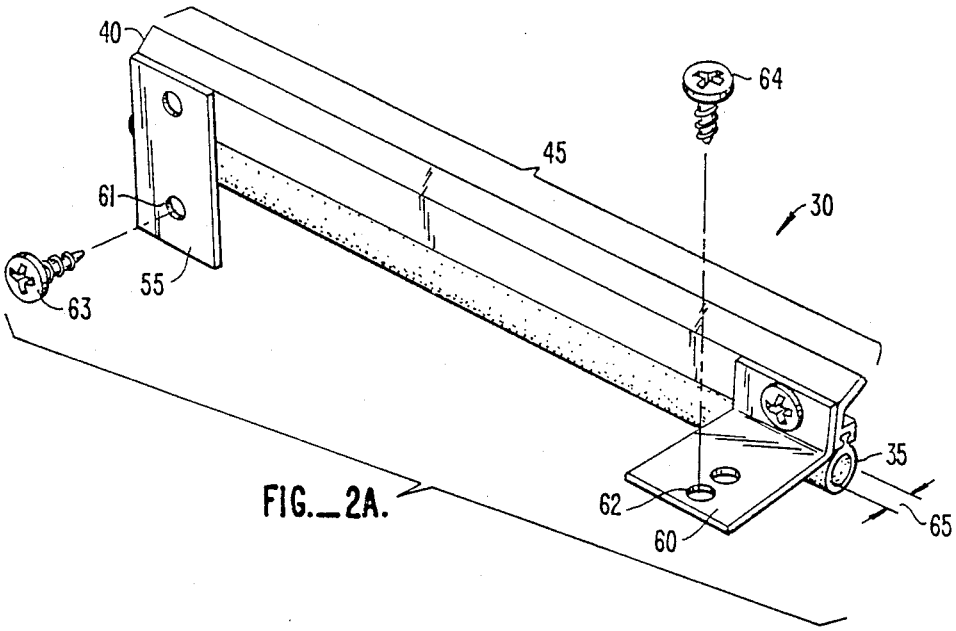
FIG. 2A is a perspective view of a coin wiper according to a first embodiment of the present invention.
Figure 2B:
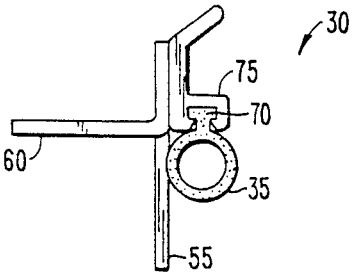
FIG. 2B is a side view of the coin wiper of FIG. 2A.

With reference to FIGS. 2A and 2B, a first embodiment of coin wiper 30 is shown as having a resilient member 35 retained by a stiffening member 40, and brackets 55 and 60 which mount wiper 30 to the coin dispensing machine. Resilient member 35 and stiffening member 40 have substantially the same length 45, about 5" in a typical application.

In the embodiment of FIGS. 2A and 2B, coin wiper 30 is a length of door weather stripping available off-the-shelf at any hardware store for mounting on the bottom and sides of a door to prevent air passage. The resilient member 35 appears to be made from a hollow elastomer material having a diameter 65 of about ¼" and a "tail" 70 extending the length 45 of resilient member 35. Stiffening member 40 appears to be extruded aluminum and, as shown best in FIG. 2A, grasps the tail 70 of the resilient member 35 between extruded jaws 75. Although stiffening member 40 is rigid, member 35 is capable of moving resiliently in response to an impact force from coins 12.

With reference to FIG. 2A, a screw 63 passes through hole 61 and attaches bracket 55 (and one end of coin wiper 30) to a tapped hole (not shown) in frame 11 of hopper 10, and a screw 64 passes through hole 62 and attaches bracket 60 (and the second end of coin wiper 30) to the frame 56 of coin elevator 14. Although brackets 55 and 60 are shown, respectively, as being planar and having a right-angle bend in FIG. 2A, it is understood that the precise shape of brackets 55 and 60 will depend upon the configuration of the coin dispensing machine with which the coin wiper 30 is used.

Figure 2D:
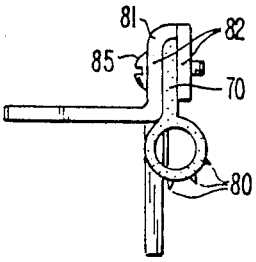
FIG. 2D is a side view of the coin wiper of FIG. 2C.
Figure 2C:
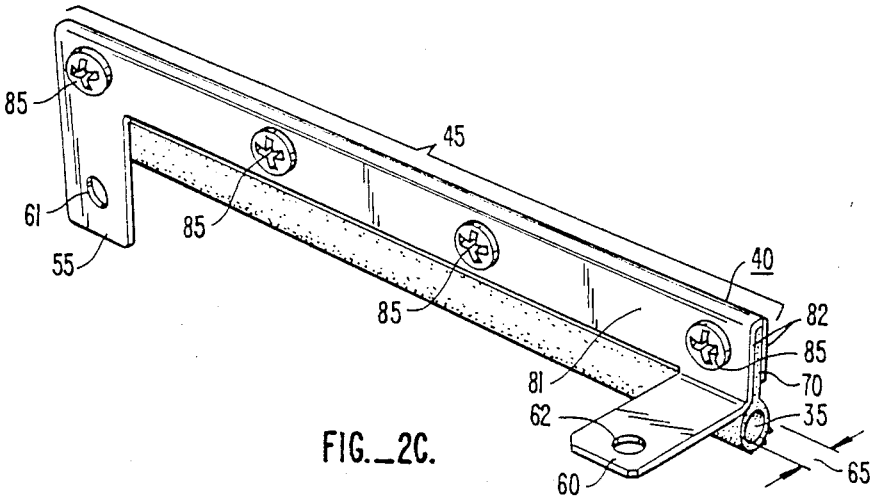
FIG. 2C is a perspective view of a coin wiper according to a second embodiment of the present invention.

FIG. 2C and 2D show a second embodiment wherein stiffening member 40 integrally includes mounting brackets 55 and 60. Stiffening member 40 is stamped from flat metal and the mounting brackets, 55 and 60, are stamped as tabs. Once stamped, stiffening member 40 is folded and crimped around resilient member 35. Screws 85 pass through holes (not shown) in surface 81 and engage screw threads (not shown) in surface 82 to firmly maintain resilient member 35. In the embodiment shown in FIGS. 2C and 2D, resilient member 35 is a length, preferable about 5", of elastomer material having a hollow tube whose diameter 65 is about 0.225" with three ridges 80 extending the length 45 of resilient member 35, protruding about 0.01" as shown. The ridges 80 are not critical but appear to improve the performance of the wiper 30. The "tail" portion 70 of member 35 is about 0.4" long and is clamped between surfaces 82 of stiffening member 40. Resilient member 35 may be "black PVC 70 Duro" material purchased from Boyd Corp., of Ceres, Calif., composition no. JML51888 BV 70. The wiper 30 shown in FIGS. 2C and 2D is mounted to a coin dispensing machine in the same manner as the configuration of FIGS. 2A and 2B.

Figure 2E:
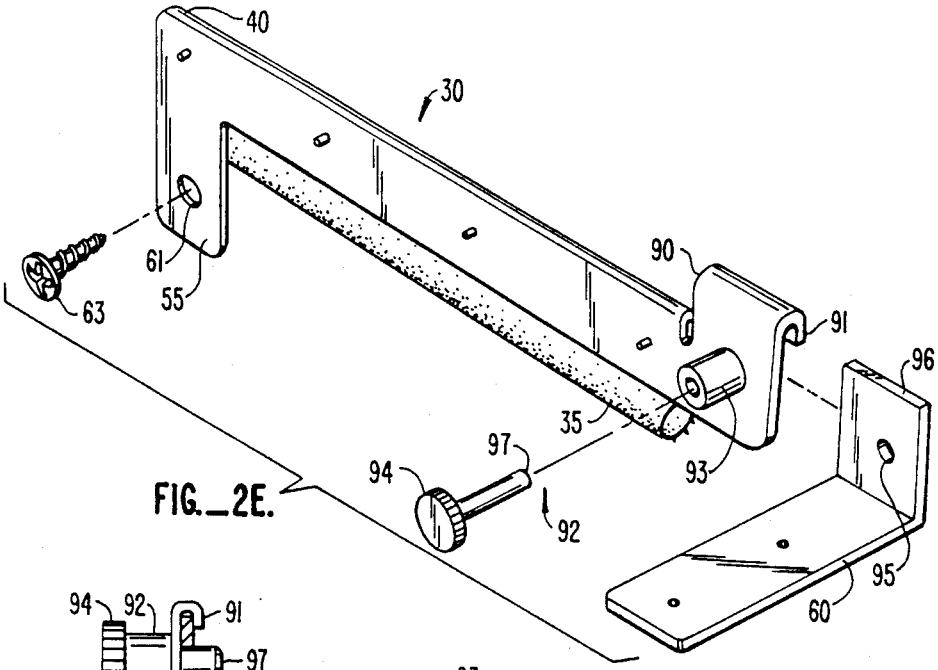
FIG. 2E is a perspective view of a coin wiper according to a third embodiment of the present invention.
Figure 2F:
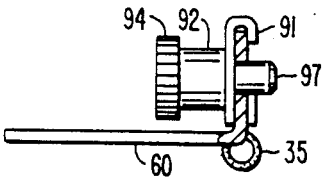
FIG. 2F is a right-side view of the coin wiper of FIG. 2E.
Figure 2G:
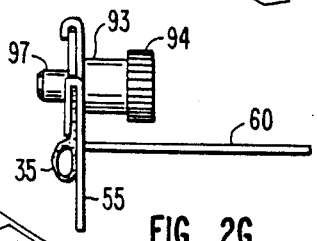
FIG. 2G is a left-side view of the coin wiper of FIG. 2E.

A third embodiment of a coin wiper 30 is shown in FIGS. 2E–2G wherein a length, typically about 5", of elastomer 35 is crimped within a stiffening member 40, similar to the construction of the embodiment of FIGS. 2C and 2D. However to facilitate rapid unjamming of a coin mechanism, should jamming occur, mounting bracket 60 is detachable from stiffening member 40. The right side 90 of stiffening member 40 includes an extended rolled-over lip 91 and a spring loaded plunger mechanism 92. Plunger mechanism 92 includes a cylindrical housing 93 rigidly attached to right side 90, and a spring loaded plunger 94 (shown in exploded view in FIG. 2E). Plunger mechanism 92 releasably retains upper portion 96 of bracket 60 within the lip 91 of the stiffening member 40. End 97 of plunger 94 passes through the cylindrical housing 93 and engages hole 95 in bracket 60, thus releasably connecting bracket 60 to stiffening member 40.

In the embodiment of FIGS. 2E–2G, screw 63 is a shoulder screw used to attach the bracket portion 55 of stiffening member 40 to frame 11 of the coin hopper 10. Bracket 60, which is not an integral part of stiffening member 40, is affixed to the frame 56 of the coin elevator with screws or similar fasteners. Plunger 94 is then pulled away from housing 93 while the stiffening member 40 is pivoted about shoulder screw 63 until upper portion 95 of bracket 60 is captured by lip 91 on the right side 90 of stiffening member 40. When bracket 60 is within lip 91, plunger 94 is released, whereupon plunger end 97 passes through hole 95, releasably connecting stiffening member 40 to bracket 60. In the event of a coin jam, coin wiper 30 may be pivoted out of the way to provide access to the jam by pulling plunger 94 away from cylinder 93, thus disengaging end 97 of plunger 94 from the hole 95 in bracket 60. Once disengagement has occurred, wiper 30 may be pivoted about the shoulder screw 63, providing rapid access to the location of any coin jam.

Figure 2H:
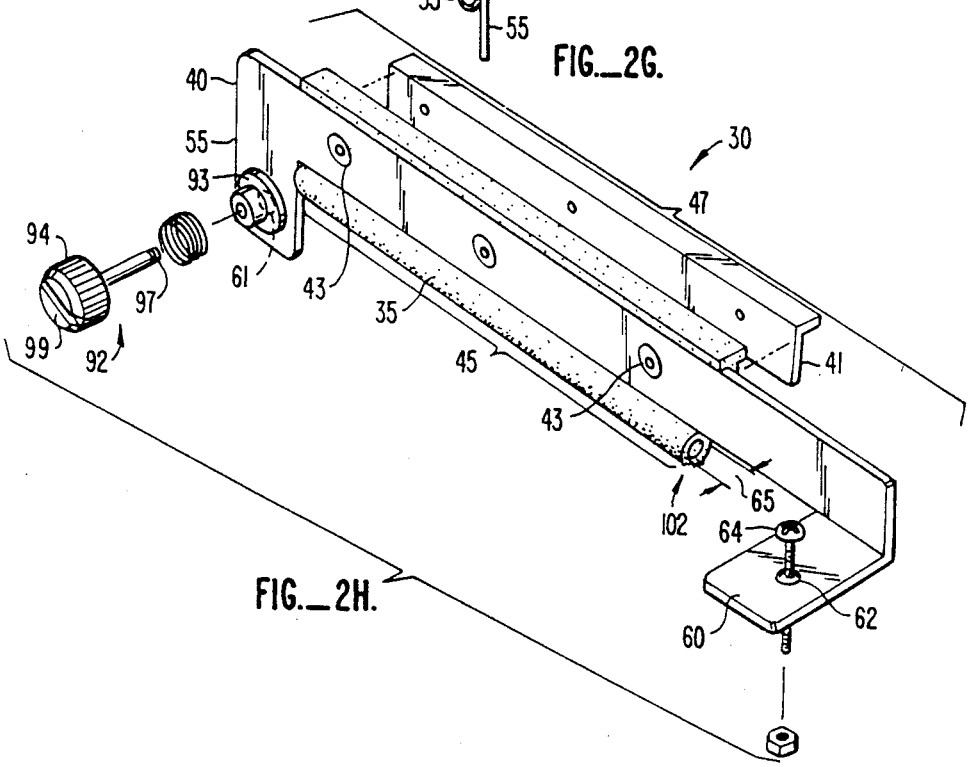
FIG. 2H is a perspective view of a coin wiper according to a fourth embodiment of the present invention.
Figure 2I:
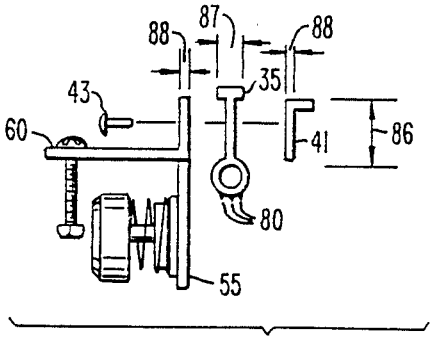
FIG. 2I is a right-side view of the coin wiper of FIG. 2H.

A fourth embodiment of coin wiper 30 is shown in FIGS. 2H and 2I wherein a length 45, typically 3.75", of elastomer 35 is attached, such as by rivets 43, between stiffening member 40 and stiffening backplate 41. Backplate 41 preferably has an "L" shaped profile for increased stiffness. Member 40 includes tabs 55 and 60, and the length 47 of member 40 is about 5.75". In this embodiment, the hollow tube portion of elastomer 35 has substantially the same dimensions and construction as discussed above with reference to the embodiment of FIGS. 2C and 2D. The non-tubular portion of elastomer 35 is substantially T-shaped, with the length 86 of the T being about 0.5", and the top width 87 of the T being about 0.375". As seen in FIG. 2I, the top width 87 substantially accommodates the thickness 88 of members 40, 41, while length 86 substantially accommodates the height of members 40, 41 as members 40, 41 contact elastomer 35.

In the embodiment of FIGS. 2H and 2I, a spring loaded plunger mechanism 92 is captured by tab 55. Mechanism 92 includes a spring loaded plunger 94 having a threaded end 97 that passes through a cylindrical housing 93 rigidly attached to tab 55. Threaded end 97 of plunger 94 passes through housing 93, through a hole 61 in the tab 55 and releasably and threadably engages threads in frame 11. The head 99 of plunger 94 is preferably ribbed or knurled, and is broad enough to function as a thumb screw, such that plunger 94 may be releasably detached from frame 11 to facilitate unjamming. In the event of a jam, plunger 94 is unscrewed, and wiper 30 is rotated about tab 60. Tab 60 is attached to frame 11 by a threaded screw 64 which passes through a hole 62 in tab 60 to engage a threaded hole (not shown) in frame 11. In use, the wiper 30 of FIGS. 2H and 2I is mounted such that the elastomer 35 adjacent tab 60 adjoins but does not overlap the coin entry chute 13 to the coin elevator 14 (see FIG. 4H). This permits elastomer 35 to control the movement of coin 12 for a longer period of time, in contrast with the embodiment of FIG. 4G, because the elastomer 35 is not deformed by the engagement with chute 13. For this reason, the embodiment of FIG. 4G is preferred over the alternate embodiments described above.

Figure 3:
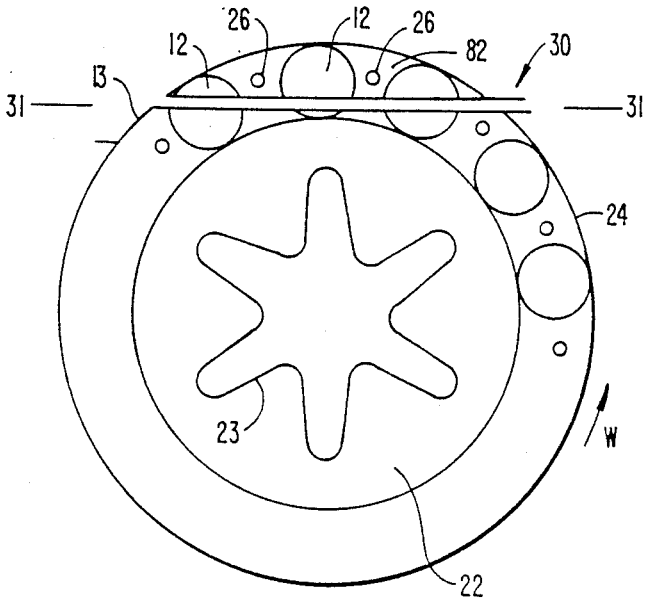
FIG. 3 is a simplified plan view of a coin wiper according to the present invention installed in a coin dispensing mechanism.

FIG. 3 is a plan view of a coin wiper 30 installed on the coin hopper 10 of FIG. 1. Coin wiper 30 is located on a chord 31 of pinwheel 22, such that coins 12 are required to pass beneath and be contacted by resilient member 35 before passing to exit opening 13. In a preferred embodiment, chord 31 defines a diameter 33 of each coin 12 as coin 12 approaches exit opening 13. Wiper 30 is mounted substantially parallel to the surface of pinwheel 22 by mounting means 55, 60, (not shown). Wiper 30 controls the shaded area 32 approaching the exit 13. As viewed in FIG. 3, pinwheel 22 rotates counterclockwise, while the coin wiper 30 remains stationary, attached by mounting means 55 and 60 (not shown) to the frame 11 of the coin hopper 10 (not shown).

FIGS. 4A–4F are side views of a coin wiper 30, taken along section line 4—4 in FIG. 1, and show a variety of potentially jamming operating conditions. In these Figs., only the resilient member 35 is shown and it is to be understood that pinwheel 22 rotates counter-clockwise, or from left to right.

Figure 4A:
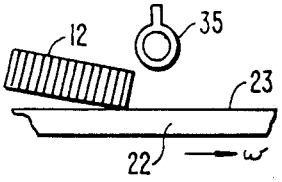
FIGS. 4A–4F show a coin wiper according to the present invention under a variety of operating conditions as viewed along Section 4—4 in FIG. 1.
Figure 4B:
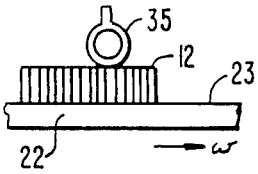
Figure 4C:
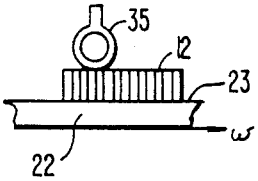

In FIG. 4A, coin 12 is, for whatever reason not seated flatly against the surface 23 of pinwheel 22. As rotation of pinwheel 22 moves coin 12 towards resilient member 35 (FIG. 4B), resilient member 35 deforms, absorbing the momentum of coin 12, and resiliently urging coil 12 down, flat against surface 23. As viewed in FIG. 4C, resilient member 35 has absorbed any momentum of coin 12, and has caused coin 12 to be seated flatly against surface 23, thus ensuring that when coin 12 passes into exit opening 13, it will not cause a jam.

Figure 4D:
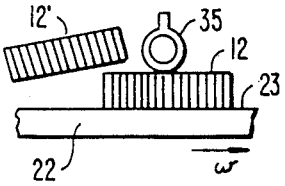
Figure 4E:
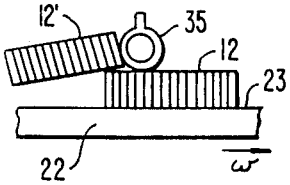
Figure 4F:
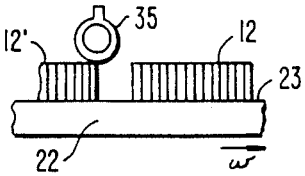
Figure 4G:
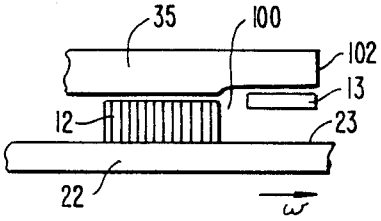
FIG. 4G shows a coin wiper according to the embodiments of FIGS. 2A–2F. as viewed along Section 4'—4' in FIG. 1.

In FIG. 4D, an extra coin 12' is, for whatever reason, seated partially atop coin 12. As shown in FIG. 4E, resilient member 35 contacts coin 12' and deforms as required to absorb momentum from coin 12' and to hold coin 12' stationery as pinwheel 22 continues to rotate beneath coin 12. As shown in FIG. 4F, resilient member 35 has held coin 12' in place while coin 12 was rotated out from under the resilient member 35 by pinwheel 22. Extra coin 12' then falls into place against upper surface 23 of pinwheel 22 and as coins 12 and 12' pass into exit opening 13, they will not cause a jam.

FIG. 4G is a side view of an installed coin wiper according to the embodiments of FIGS. 2A–2G. In FIG. 4G, tab 60 is adjacent the coin entry chute 13 such that end 102 of the resilient member overlaps chute 13. This overlap produces an undesired gap 100 as seen in FIG. 4G. An undesired side effect of gap 100 is that coin 12 is not fully controlled as it enters chute 13, and may not be completely flat atop pinwheel 22.

Figure 4H:
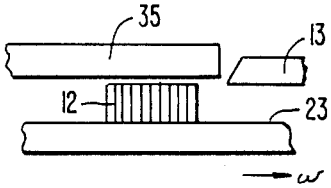
FIG. 4H shows a coin wiper according to the embodiment of FIGS. 2H, 2I, as viewed along section 4'—4' in FIG. 1.

By contrast, as shown in FIG. 4H, the embodiment of FIGS. 2H and 2I shortens the length of the resilient member 35 such that end 102 adjoins but does not overlap chute 13. As a result, there is substantially no gap and coin 12 is controlled by wiper 35 substantially until the coin 12 enters chute 13. Because there is no gap, the structure of FIGS. 2H and 2I offers somewhat superior coin controlling characteristics than the other embodiments shown in FIGS. 2A–2G.

Modifications and variations may be made to the disclosed embodiments without departing from the scope of the invention as defined by the following claims. For example, other forms of resilient members may be possible. A resilient member having a triangular cross section (with the apex adjacent the pinwheel surface) might provide suitable wiping action, while the base of the triangle might provide sufficient rigidity such that a separate stiffening member is no longer required.

What is claimed is:

1. In a coin dispensing machine of the type having a stationary housing and a rotating pinwheel for dispensing coins, lying on a surface of the pinwheel through an exit opening, a coin wiper comprising:

a resilient member, for performing a corrective function on coins improperly seated on the pinwheel surface;

a stiffening member for holding the resilient member; and mounting means for mounting the resilient member in the housing at a chosen position overlying the pinwheel surface such that coins on the pinwheel surface contact said resilient member as said coins pass beneath said resilient member before passing to the exit opening, said mounting means including a spring loaded plunger release for releasably mounting a first end of the coin wiper to the coin dispensing machine, and a screw for attaching the second end of the wiper to the coin dispensing machine;

said resilient member adapted to absorb momentum of improperly positioned coins so as to force the improperly positioned coins to lie flatly against the pinwheel surface before passing to the exit opening or to be swept off the pinwheel surface;

whereby coin jamming in the exit opening is substantially reduced, and wherein unjamming of the coin dispensing machine is facilitated by releasing said first end of the coin wiper from the coin dispensing machine and rotating the coin wiper about the screw in said second end.

2. In a coin dispensing machine of the type having a stationary housing and a rotating pinwheel for dispensing coins, lying on a surface of the pinwheel through an exit opening, a coin wiper comprising:

a resilient member, for performing a corrective function on coins improperly seated on the pinwheel surface;

a stiffening member for holding the resilient member; and mounting means for mounting the resilient member in the housing at a chosen position overlying the pinwheel surface such that coins on the pinwheel surface contact said resilient member as said coins pass beneath said resilient member before passing to the exit opening, said mounting means including a shoulder screw, pivotally mounting a first end of the coin wiper to the coin dispensing machine, and a spring loaded plunger mechanism, releasably mounting a second end of the coin wiper to the coin dispensing machine;

said resilient member adapted to absorb momentum of improperly positioned coins so as to force the improperly positioned coins to lie flatly against the pinwheel surface before passing to the exit opening or to be swept of the pinwheel surface;

whereby coin jamming in the exit opening is substantially reduced, and wherein unjamming of the coin dispensing machine is facilitated by releasing said second end of the coin wiper from the coin dispensing machine and rotating the coin wiper about the shoulder screw.

3. In a coin dispensing machine of the type having a stationary housing and a rotating pinwheel for dispensing coins, lying on a surface of the pinwheel, through an exit opening into a coin elevator, a coin wiper comprising:

a resilient member, having a length and a longitudinal axis, for performing a corrective function on coins improperly seated on the pinwheel surface;

mounting means for mounting the resilient member in the housing at a chosen position overlying the pinwheel surface such that said longitudinal axis is parallel to the pinwheel surface and such that coins on the pinwheel surface contact said resilient member as said coins pass beneath said resilient member before passing to the exit opening, said mounting means including a spring loaded plunger release for releasably mounting a first end of the coin wiper to the coin dispensing machine, and a screw for attaching the second end of the wiper to the coin dispensing machine;

said wiper being mounted such that said longitudinal axis defines a chord of the pinwheel coinciding with a diameter of a coin on the pinwheel surface as said coin approaches the exit opening;

said resilient member adapted to absorb momentum of improperly positioned coins so as to force the improperly positioned coins to lie flatly against the pinwheel surface before passing to the exit opening, or to be swept off the pinwheel surface;

whereby coin jamming in the exit opening is substantially reduced and wherein unjamming of the coin dispensing machine is facilitated by releasing said first end of the coin wiper from the coin dispensing machine and rotating the coin wiper about the screw in said second end.

4. In a coin dispensing machine of the type having a stationary housing and a rotating pinwheel for dispensing coins, lying on a surface of the pinwheel, through an exit opening into a coin elevator, a coin wiper comprising:

a resilient member, having a length and a longitudinal axis, for performing a corrective function on coins improperly seated on the pinwheel surface;

mounting means for mounting the resilient member in the housing at a chosen position overlying the pinwheel surface such that said longitudinal axis is parallel to the pinwheel surface and such that coins on the pinwheel surface contact said resilient member as said coins pass beneath said resilient member before passing to the exit opening, said mounting means including a shoulder screw, pivotally mounting a first end of the coin wiper to the coin dispensing machine, and a spring loaded plunger mechanism, releasably mounting a second end of the coin wiper to the coin dispensing machine;

said wiper being mounted such that said longitudinal axis defines a chord of the pinwheel coinciding with a diameter of a coin on the pinwheel surface as said coin approaches the exit opening;

said resilient member adapted to absorb momentum of improperly positioned coins so as to force the improperly positioned coins to lie flatly against the pinwheel surface before passing to the exit opening, or to be swept off the pinwheel surface;

whereby coin jamming in the exit opening is substantially reduced, and wherein unjamming of the coin dispensing machine is facilitated by releasing said second end of the coin wiper from the coin dispensing machine and rotating the coin wiper about the shoulder screw.

5. A method of substantially eliminating coin jams in an exit opening of a coin dispensing machine of the type having a housing and a rotating pinwheel for dispensing coins, lying on a surface of the pinwheel, through the exit opening, comprising the steps of:

selecting a resilient member, for performing a corrective function on coins improperly seated on the pinwheel surface, the resilient member adapted to absorb momentum of coins moving on the pinwheel surface;

positioning said resilient member in the housing at a chosen position overlying the surface of the pinwheel including the step of pivotally mounting a first end of the coin wiper to the coin dispensing machine, and releasably mounting a second end of the coin wiper with a spring loaded plunger mechanism to the coin dispensing machine;

selecting the chosen position such that coins on the pinwheel surface contact said resilient member as said coins pass beneath said resilient member before passing to the exit opening;

moving the pinwheel surface substantially parallel to a longitudinal axis of said resilient member;

resiliently contacting improperly positioned coins on the pinwheel surface with said resilient member; and repositioning improperly positioned coins on the pinwheel surface with said resilient member such that improperly positioned coins are forced to lie flat on the pinwheel surface, or be swept off the pinwheel surface.

* * * * *